United States Patent [19]

Berggren

[11] 3,957,214

[45] *May 18, 1976

[54] REFINING MACHINE

[75] Inventor: Torsten Lennart Berggren, Nassjo, Sweden

[73] Assignee: AB Krima Maskinfabrik, Nassjo, Sweden

[ * ] Notice: The portion of the term of this patent subsequent to Sept. 2, 1992, has been disclaimed.

[22] Filed: Mar. 31, 1975

[21] Appl. No.: 563,676

Related U.S. Application Data

[63] Continuation-in-part of Ser. No. 412,464, Nov. 2, 1973, Pat. No. 3,902,673.

[30] Foreign Application Priority Data

Nov. 7, 1972 Sweden ..... 14386/72

[52] U.S. Cl. ..... 241/246; 241/257 R

[51] Int. Cl.[2] ..... B02C 7/08

[58] Field of Search ..... 241/162, 188 A, 246, 241/248, 251, 257 R, 261.2, 275

[56] References Cited

UNITED STATES PATENTS

| | | | |
|---|---|---|---|
| 297,049 | 4/1884 | Winchell | 241/248 |
| 1,762,592 | 6/1930 | Schwarz | 241/162 |
| 2,382,040 | 8/1945 | Erickson | 241/162 X |
| 2,937,815 | 5/1960 | Eirich et al. | 241/257 R |
| 3,137,334 | 6/1964 | Steele | 241/246 X |
| 3,347,178 | 10/1967 | Mendoza | 241/246 X |
| 3,514,044 | 5/1970 | Maier | 241/275 X |

*Primary Examiner*—Granville Y. Custer, Jr.
*Assistant Examiner*—Howard N. Goldberg
*Attorney, Agent, or Firm*—Flynn & Frishauf

[57] ABSTRACT

A refining machine for fragmented beating material comprises a rotationally symmetric, annular infeed channel for the beating material, the infeed channel being formed between a central body and an outer part surrounding the central body. The annular infeed channel has a gradually increasing inner and outer diameter in the feed direction of the beating material, and the central body and outer part are rotatably mounted relative to each other, each supporting its own annular part of a beating means which is arranged to be passed by the beating material after being fed through the infeed channel. The infeed channel redirects the movement of the beating material essentially radially outwardly in relation to the center of rotation of the beating means.

2 Claims, 2 Drawing Figures

REFINING MACHINE

This is a continuation of application Ser. No. 412,464 filed Nov. 2, 1973 now U.S. Pat. No. 3,902,673.

This invention relates to a refining machine for fragmented beating material such as wood chippings, shavings and the like as well as paper pulps in higher, non-pumpable concentrations, and more specifically, the invention relates to the feed part of the refining machine, in which the beating material is redirected from an axial to an essentially radial movement.

In known refining machines of this kind the infeed channel is usually constructed either as a channel arranged in line with the axis of rotation (see e.g. Swedish Pat. No. 321,143), the beating material being imparted a movement in the radial direction with the aid of ejector vanes only after it has arrived largely right up to the flat rotor disc, or else the infeed channel is constructed as an axially extended, annular, successively narrowing infeed zone (see e.g. Swedish Pat. No. 178,642), the limiting walls of the infeed zone being provided with opposite bars for achievement of a preliminary processing or rough grinding of the beating material.

The first-mentioned known construction of the infeed channel has the disadvantage that when the highly concentrated and/or fragmented beating material is fed towards the ejector vanes, blocking easily occurs in the final end of the cylindrical feed pipe, the reason being that the transition from axial to radial movement is all too sudden. In order to eliminate irregular or uneven feed in this design it is usually necessary to add a certain quantity of water to the beating material before it is fed in for refining. This dilution of the beating material has a detrimental effect on the refining result and raises the energy consumption counted per ton of beating material, Moreover, it is usually necessary to apply high power to the infeed means in order to overcome continuous tendencies of blocking.

The disadvantage of the other alternative construction of the infeed channel is that in pretreatment of the fed beating material in the infeed zone an extremely marked limitation is obtained in the capacity of the refining machine which is due to, among other things, the limited diameter and thus limited peripheral speed of the rotating part. Since the surface of the rotating part is here normally given such a shape that the generatrices to it are S-shaped, there is obtained from that part of the S-curve which has a convex shape counted from the rotor shaft a strong counteraction against the infeed of the beating material. This counteraction arises in consequence of the fact that the rotating part has a tendency to form a cavity in the fed plug of beating material, which makes impossible continuous and uniform feeding, something which is wholly decisive for the attainment of a good refining result. For example, in refining of wood chippings with this type of feed there is not obtained in the prebeating or rough-grinding zone a wanted homogeneous fibrous material but instead a heterogeneous material consisting of wood flour and splinters. If, for example, in refining of chips, steam is generated in the beating zone the feed will be pulsating and the quality of the refined beating material will thus be irregular. The pretreatment also involves rapid wear of the bars of both rotor and stator which, since these parts are not replaceable, causes the running costs for a machine of this type to be relatively high.

The main object of this invention is to achieve an improved refining machine for fragmented beating material such as wood chippings, shavings and the like as well as for paper pulp in higher, non-pumpable concentrations, which gives a uniform and high quality of refined material.

SUMMARY OF THE INVENTION

The invention is based on the realization that in order for a good refining result to be obtained it is absolutely essential to achieve a uniform and continuous flow of beating material to the beating means. This implies that the infeed channel must not contain any stages or have any constriction or protruding part which leads to reoccurring tendencies to blockages or cavities in the fed material, since this results in a pulsating flow of the material to the beating means. It is also of the utmost importance that no prebeating or precrushing of the beating material takes place in the infeed channel, which otherwise would also give rise to a varying flow. Such precrushing is unavoidably obtained if feed vanes protruding into the infeed channel have a relatively small height, which allows fragmented beating material to penetrate between them and the opposite surface.

A refining machine according to the invention comprises a rotationally symmetric, annular infeed channel for the beating material formed between a central body and an outer part surrounding the central body. The annular infeed channel in the feed direction has increasing inner and outer diameters respectively, and the central body and outer part are rotatable in relation to each other, each supporting its own annular part of a beating means, which is arranged to be passed by the beating material after being in the infeed channel, redirected for movement essentially radially outwards in relation to the centre of rotation of the beating means. The particular distinguishing feature of the refining machine is the combination that the generatrices to the two opposing limiting surfaces of the infeed channel have a uniform, continuous curvature along their entire length and out towards the beating means a successively decreasing inclination in relation thereto, that the said limiting surfaces are of such a shape that the total flow area of the channel increases continuously in a direction out towards the beating means, that the limiting surfaces stagelessly pass into the said beating means and that one of the limiting surfaces of the infeed channel which is arranged to rotate is provided with coiled vanes protruding into the said channel which extend largely right up to the opposite limiting surface and have a shape adapted to the said surface for division of the infeed channel into spiral-shaped flow channels.

In a preferred embodiment of this arrangement, the central body is constructed as a rotor and the part surrounding it as a stator.

By avoiding, in accordance with the invention, treatment of the beating material in the infeed channel and instead utilizing a combined coarse and fine beating means and making the limiting surfaces of the infeed channel with a uniform, continuous curvature, at the same time as the total flow area of the channel increases in the direction out towards the grinding means, the resistance against feeding of the beating means is reduced to a minimum and all tendencies towards blocking of the feed are avoided. This results in a very uniform and high quality of refined material.

BRIEF DESCRIPTION OF THE DRAWINGS

The invention will now be described in greater detail with reference to the accompanying drawing, in which.

DETAILED DESCRIPTION OF ILLUSTRATED EMBODIMENTS

Figure 1:
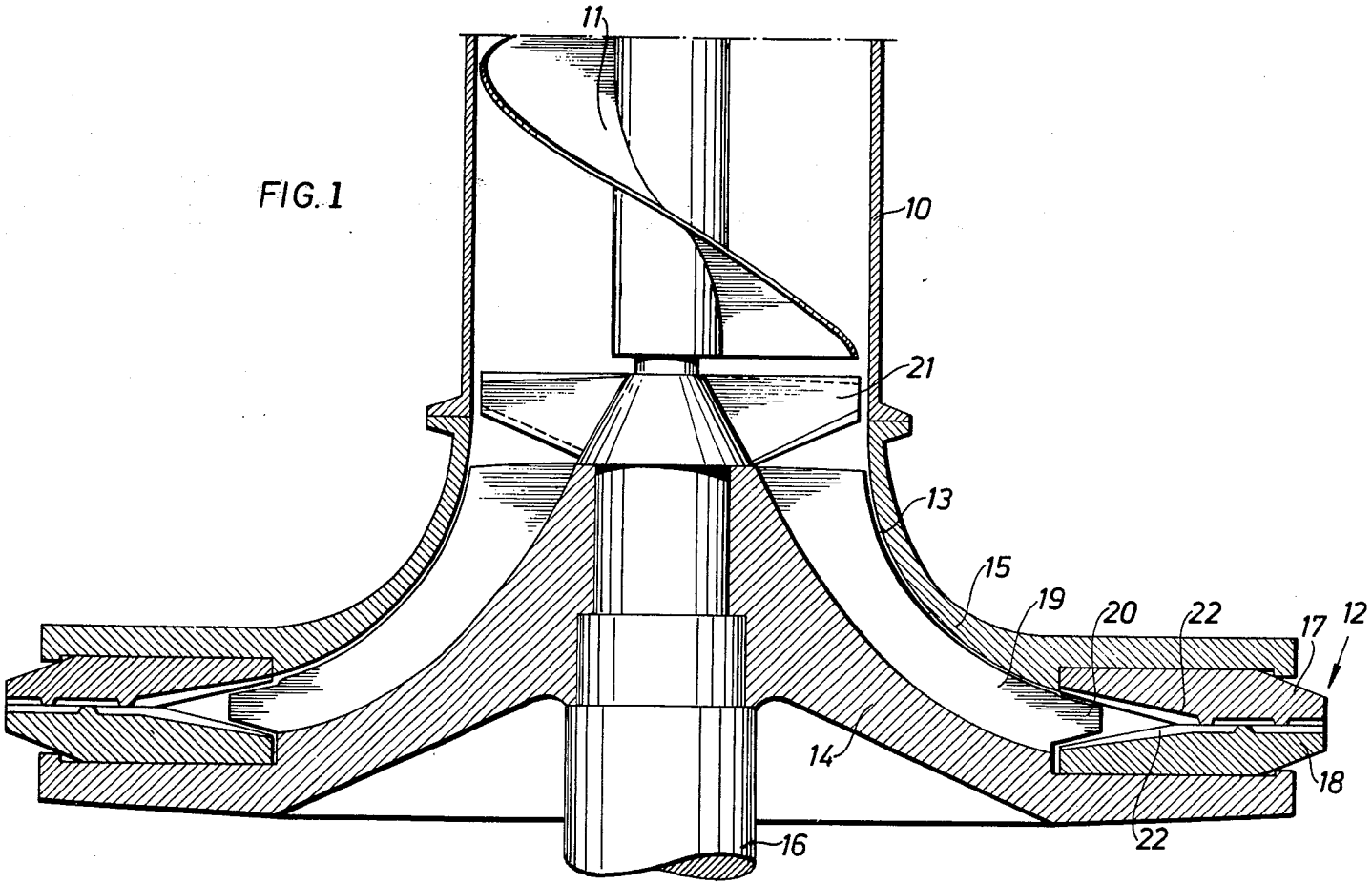
FIG. 1 shows a preferred embodiment of the refining machine according to the invention, partly in section

In the drawing, reference numeral 10 designates a transport channel for a beating material which can comprise, for instance, wood chippings, shavings, paper pulp and the like. The material is fed along the channel 10 by means of a feed screw 11. The transport channel is connected by suitable means, for example via interconnected flanges, to a refining machine comprising an annular beating means 12, to which the beating material is fed via a rotationally symmetric, annular infeed channel 13. The outer and inner diameters of the infeed channel 13 increase continuously in the direction from the transport channel 10 out towards the beating means 12 in such a manner that the beating material in the said channel is redirected from an essentially axial movement at the transition to the infeed channel to an essentially radial movement upon entering into the beating means.

The infeed channel 13 is bounded by a rotor 14 and a fixed outer part 15 surrounding rotor 14. The rotor is driven via an axle 16 by a drive motor (not shown). The surfaces of the rotor 14 and outer part 15 respectively that limit the annular, rotationally symmetric infeed channel 13 are so constructed that the generatrices to them have a uniform, continuous curvature along their entire length and change stagelessly into the key-shaped limiting surfaces of the beating means 12. The shown form of the infeed channel 13 also gives a continuously increased flow area from the transport channel 10 and out towards the beating means for the beating material without any constriction.

Figure 2:
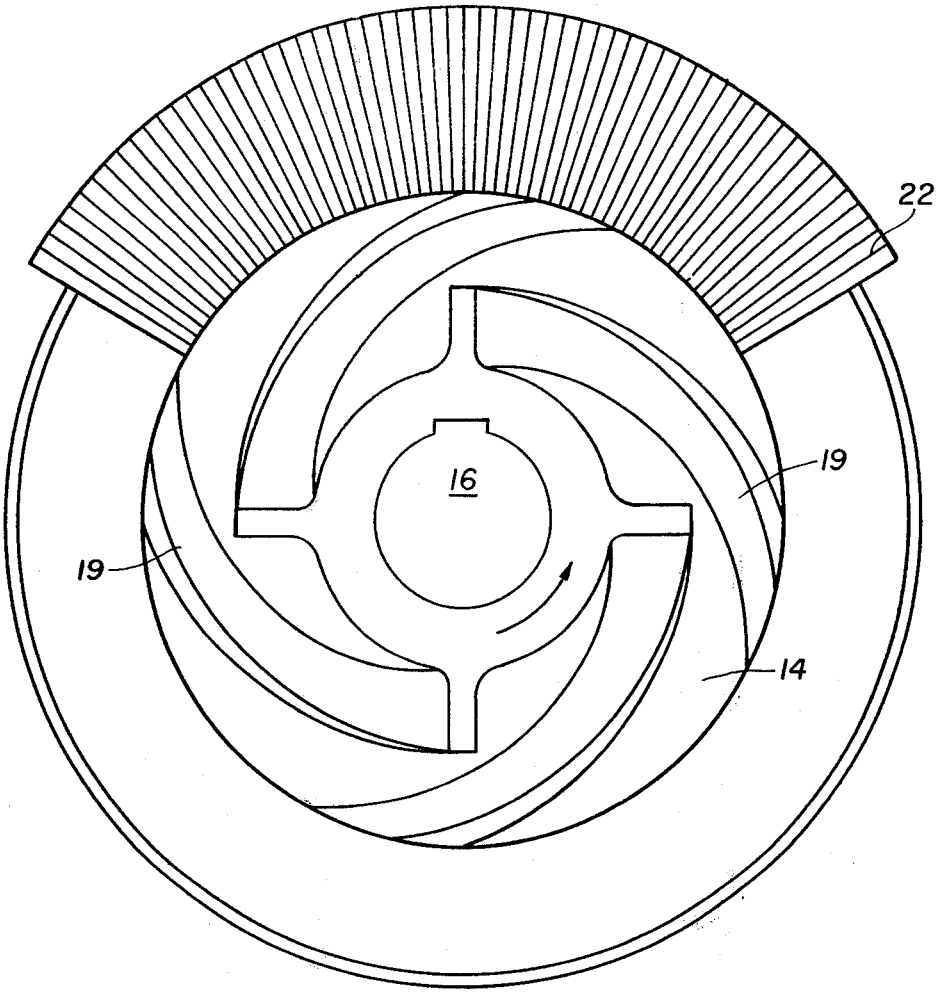
FIG. 2 is a top view of the vanes and beating means with the housing removed.

The beating means 12 can comprise any known beating means which includes two annular discs 17 and 18 which are rotatable in relation to each other. The discs are provided with interacting radial and/or lateral bars 22 and form a key-shaped prebeating or rough grinding zone diminishing from the infeed channel and a following final beating zone. For effective feeding and uniform distribution of the beating material in the key-shaped prebeating zone of the beating means the rotor 14 is equipped with coiled or spiral-shaped twisted vanes 19. See FIG. 2. The feed vanes 19 are terminated with a tongue 20 which protrudes into the rough-grinding zone of the beating means 12. The tongues 20 can appropriately be detachably mounted on the feed vanes, so that they can easily be exchanged, and are preferably made with an edge surface coated with an abrasion-resistant material. These tongues serve to effectuate the pressing in of the beating material into the prebeating zone and counteract any tendency of steam that may be generated in the final boating zone to press back the beating material.

Mounted between the feed screw 11 fitted in the transport channel 10 and the infeed channel 13 is a propeller 21. The propeller is intended to divide and homogenize the beating material fed via the screw and is suitably made with the working edges thereof coated with abrasion-resistant material. In addition, the propeller 21 helps to impart to the beating material such a movement that the entry thereof into the spiral-shaped pockets serves as flow channels formed between the vanes 19 of the rotor 14. To facilitate passage of the beating material through the infeed channel 13 the surfaces which come into contact with the beating material are appropriately coated with a wear-resistant material having low coefficient of friction against the envisaged beating material.

The described device is thus made to exercise the least possible resistance against the infeed of the beating material. It is then extremely important for the surfaces limiting the infeed channel 13 to have the shown uniform and continuous curvature and the stageless transition into the limiting surfaces of the beating means. The curve shape of the two limiting surfaces appropriately comprises area with different radii. No pretreatment of the beating material takes place in the infeed channel which is so constructed that its flow area increases continuously from the inlet side to the discharge side, the total increase in area amounting appropriately to 100–200%.

The embodiment of the invention described above can be varied in several respects without departing from the invention concept. For example, the infeed of the beating material and the relative rotation between the two discs of the beating means can be achieved by providing the outer part 15 with high vanes and allowing it to rotate around the central body 14. Alternatively, both the body 14 and the part 15 can be arranged to rotate with different speeds or in different directions around a common rotational shaft. The shape of the curve of the infeed channel's limiting surfaces can be chosen as desired, as long as the demands that the generatrices of the surfaces must have a uniform, continuous curvature with decreasing inclination in relation to the beating means and that the flow area of the channel must increase in the direction out towards the beating means are satisfied.

What is claimed is:

1. A refining machine for fragmented beating material such as wood chippings, shavings and the like as well as for paper pulp in higher, non-pumpable concentrations, comprising:

a central body;

an outer part surrounding said body, said central body and said outer part being rotatable in relation to each other about an axis of rotation, said central body and said outer part being spaced from each other so that a rotationally symmetric, annular infeed channel is formed between said central body and said outer part, said infeed channel feeding beating material over at least a portion thereof generally in the direction of said axis of rotation and having, in the feed direction of said feeding material, gradually increasing inner and outer diameters, respectively;

beating means including first and second annular parts which are respectively supported on said central body and said outer part, said beating means being arranged to be passed by the beating material after said beating material is passed through said infeed channel;

the improvement wherein:

said infeed channel is shaped to redirect movement of said beating material from a generally axial movement to a movement essentially radially outwards in relation to the axis of rotation of said beating means;

the generatrices to the two opposing limiting surfaces of said infeed channel have a uniform, continuous curvature along their entire length, and further have a successively decreasing inclination out towards said beating means, said inclination being in relation to said beating means;

said opposing limiting surfaces of said infeed channel converge in the direction out towards said beating means, and are shaped such that the total flow area of said infeed channel increases continuously in a direction out towards said beating means;

the limiting surfaces of said infeed channel stagelessly pass outwardly into said beating means; and means is provided to divide said infeed channel into a plurality of generally spiral-shaped flow channels, said dividing means including spiral-shaped vanes mounted on one of said limiting surfaces of said infeed channel which is arranged to rotate, said spiral-shaped vanes protruding into said infeed channel and which extend substantially up to the opposite limiting surface, thereby dividing said infeed channel into said spiral-shaped flow channels.

2. A refining machine according to claim 1 wherein said central body is rotatable about said axis of rotation and said outer part surrounding said central body is stationary.

* * * * *